US006105469A

United States Patent [19]

Gracy

[11] Patent Number: 6,105,469

[45] Date of Patent: Aug. 22, 2000

[54] MATERIAL REMOVAL TOOL WITH WEDGE AND FULCRUM

[76] Inventor: Mark S. Gracy, 1140 Queensbury, Pittsburgh, Pa. 15205

[21] Appl. No.: 09/134,643

[22] Filed: Aug. 14, 1998

[51] Int. Cl.[7] ..... E04D 15/00

[52] U.S. Cl. ..... 81/45; 30/169

[58] Field of Search ..... 30/169, 172; 81/45; D8/10

[56] References Cited

U.S. PATENT DOCUMENTS

D. 389,024 1/1998 Jensen, Jr. ..... D8/10
4,466,188 8/1984 Svendsgaard ..... 30/172
5,095,573 3/1992 Henke et al. ..... 30/169 X
5,875,515 3/1999 Dallas ..... 30/169 X

*Primary Examiner*—D. S. Meislin
*Attorney, Agent, or Firm*—J. Stewart Brams

[57] ABSTRACT

An elongated handle has a grip at a first end thereof, and a head at a second end thereof. The head comprises a plate having a leading edge and a trailing edge. Teeth for ripping building material are provided at the leading edge. The plate is planar except for the teeth which have tapered ends. A wedge-shaped wing is disposed along each of the side edges, extending outwardly from a second side of the plate and forming a perpendicular angle with the plate. A fulcrum for leverage is formed by ears which extend through a plane of the plate, and which connect to the handle.

6 Claims, 4 Drawing Sheets

MATERIAL REMOVAL TOOL WITH WEDGE AND FULCRUM

BACKGROUND OF THE INVENTION

1. Field of the Invention

The present invention relates to hand tools, particularly to tools for the removal of layers of building material such as roof shingles and vinyl flooring.

2. Description of the Related Art

Material removal tools are known in the prior art. An example is U.S. Pat. No. D389,024 to Jensen, Jr. This tool has a pivoting head for use at multiple angles with respect to the handle.

SUMMARY OF THE INVENTION

The material removal tool of the present invention includes an elongated handle having a grip at a first end thereof, and a head at a second end thereof.

The head comprises a plate having a leading edge and a trailing edge. Teeth for ripping building material are provided at the leading edge. The plate is planar except for the teeth which have tapered ends.

The plate has a first side opposite a second side. The plate has opposing side edges which each extend between the leading and trailing edges. A wedge-shaped wing is disposed along each of the side edges, extending outwardly from the second side of the plate and forming a perpendicular angle with the plate.

Two ears are located at the trailing edge of the plate. The ears pass through a plane of the plate, and a leading end of each of the ears is disposed primarily on the second side of the plate.

The second end of the handle is configured to fit between the ears. Bosses extend outwardly from opposing sides of the handle near the second end of the handle. A notch extends inwardly from the leading end of each of the ears. The notches are configured to receive the bosses therein such that the bosses are on the second side of the plate. When the bosses are fully received within the notches, the ears extend beyond the sleeve and the handle. A curved fulcrum is formed on the leading end of each of the ears, on the second side of the plate.

A plurality of holes are disposed near the trailing end of each of the ears. A pin is configured to penetrate a one of the holes in each of the ears, and to penetrate the handle at a location inboard of the bosses. When the pin is extended through the ears and the handle and the bosses are fully received within the notches, the head is securely retained on the handle.

DETAILED DESCRIPTION

Figure 1:
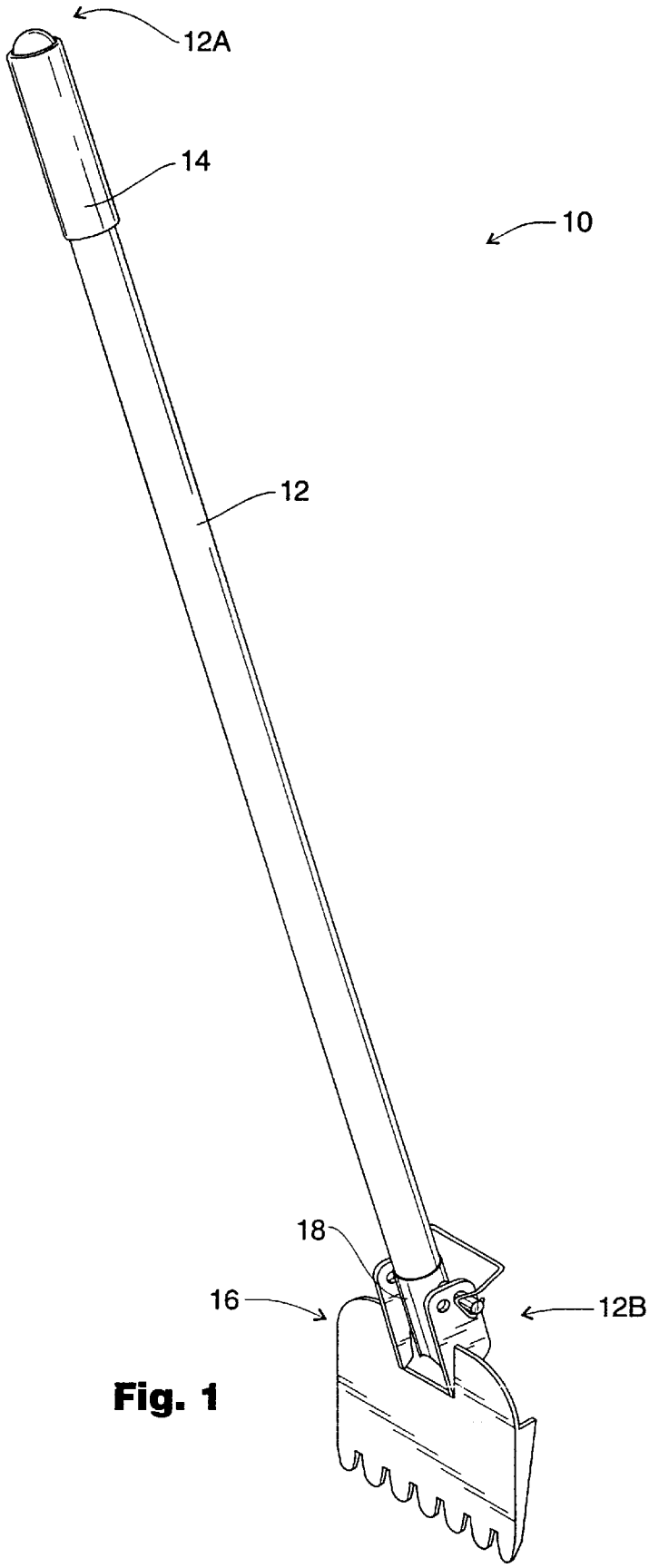
FIG. 1 is a front perspective view of a material removal tool of the present invention.

FIG. 1 is a front perspective view of a material removal tool 10 of the present invention. The tool 10 comprises an elongated handle 12 having a grip 14 at a first end 12A thereof, and a head 16 at a second end 12B thereof.

Figure 2:
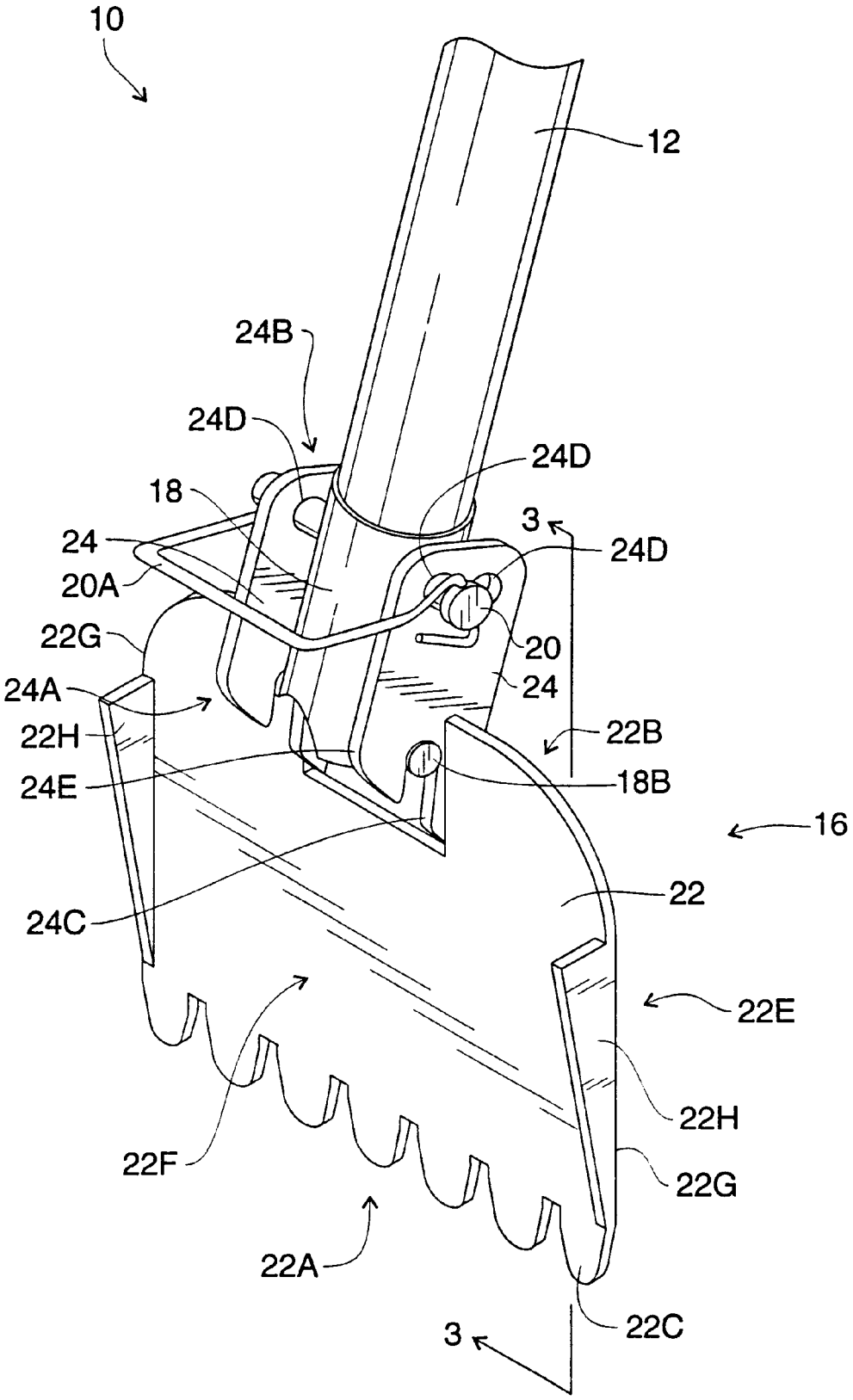
FIG. 2 is a partial rear perspective view of the tool.
Figure 2A:
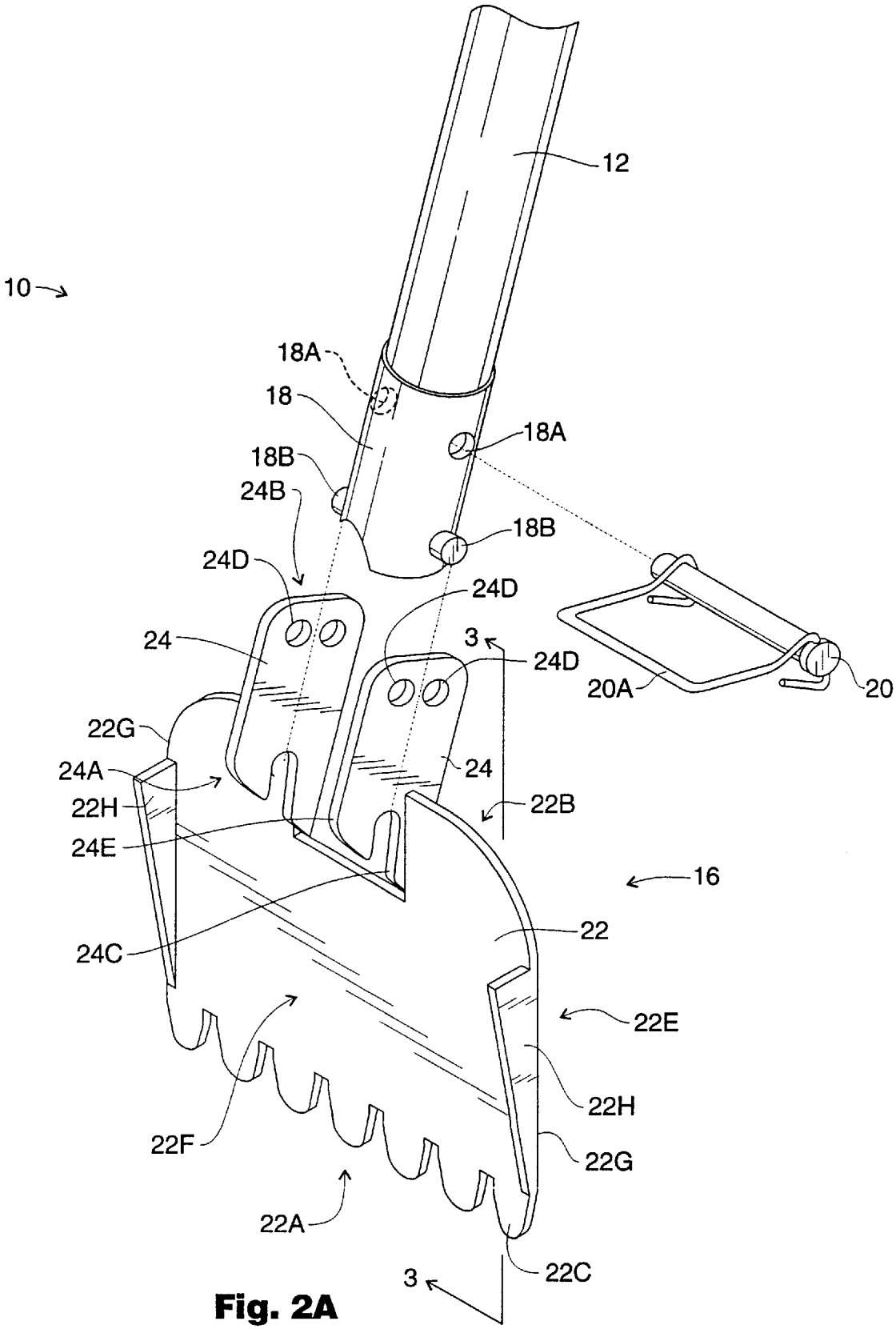
FIG. 2A is an exploded rear perspective view of the tool.

FIG. 2 is a partial, enlarged rear perspective view of the tool 10. FIG. 2A is an exploded rear perspective view of the tool. Referring to FIGS. 1, 2 and 2A, a sleeve 18 is disposed at the second end 12B of the handle. The sleeve 18 is provided primarily for added strength at the second end 12B. Apertures 18A which penetrate the sleeve 18 and the handle 12 near a trailing end of the sleeve 18 permit a pin 20 to be extended there-through, for retaining the head 16 on the handle 12. A generally u-shaped clip 20A is pivotally attached to one end of the pin 20, and removably attachable to another end of the pin 20, for retaining the pin 20 on the head 16 and the handle 12.

Figure 3:
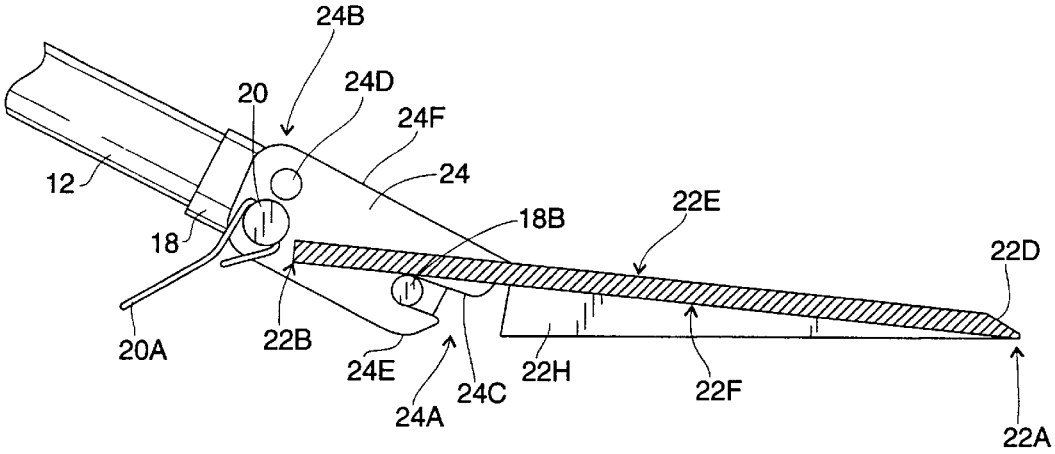
FIG. 3 is a cross-sectional view of the tool, taken along line 3—3 of FIG. 2.
Figure 3A:
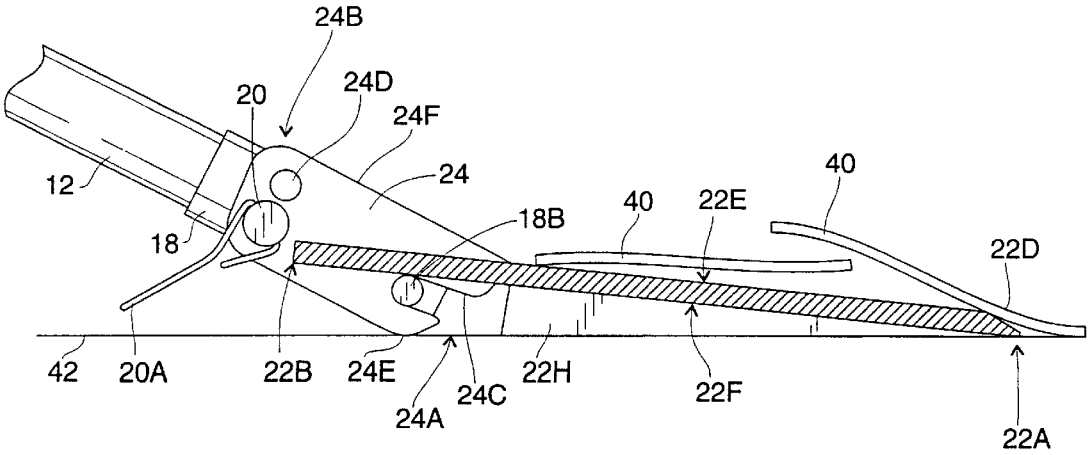
FIG. 3A is a cross-sectional view similar to FIG. 3, showing the tool in use.

FIG. 3 is a cross-sectional view of the tool taken along line 3—3 of FIG. 2. FIG. 3A is a cross-sectional view similar to FIG. 3, showing the tool 10 in use. Referring to FIGS. 2–3A, the head 16 comprises a plate 22 having a leading edge 22A and a trailing edge 22B. Teeth 22C for ripping building material 40 are provided at the leading edge 22A. The plate 22 is planar except for the teeth 22C which have tapered ends 22D.

The plate 22 has a first side 22E opposite a second side 22F. The plate 22 has opposing side edges 22G which each extend between the leading and trailing edges 22A, 22B. A wedge-shaped wing 22H is disposed along each of the side edges 22G, extending outwardly from the second side 22F of the plate 22 and forming a perpendicular angle with the plate 22. The wings 22H each taper from a wider end near the trailing edge 22B to a narrow end near the leading edge 22A.

Two ears 24 are located at the trailing edge 22B of the plate 22. The ears 24 are planar and parallel to each other. A longitudinal axis of each of the ears 24 forms an acute angle with respect to the plate 22.

The ears 24 each have a leading end 24A and a trailing end 24B. The ears 24 pass through a plane of the plate 22, and the leading end 24A of each of the ears 24 is disposed primarily on the second side 22F of the plate 22.

The sleeve 18 is configured to fit between the ears 24. Bosses 18B extend outwardly from opposing sides of the sleeve 18 near a leading end of the sleeve 18. A notch 24C extends inwardly from the leading end 24A of each of the ears 24. The notches 24C are configured to receive the bosses 18B therein such that the bosses 18B are on the second side 22F of the plate 22. When the bosses 18B are fully received within the notches 24C, the ears 24B extend beyond the sleeve 18 and the handle 12. A curved fulcrum 24E is formed on the leading end 24A of each of the ears 24, on the second side 22F of the plate 22.

A plurality of holes 24D are disposed near the trailing end 24B of each of the ears 24. The holes 24D are configured to receive the pin 20 there-through. Because a plurality of holes 24D are provided, the head 16 may retained on the handle 12 such that the plate 22 forms various angles with respect to the handle 12.

Referring primarily to FIG. 3A, a user is able to maintain a consistent inclined angle of the plate 22 with respect to the base 42 from which the building material 40 is being removed, by urging the wings 22H against the base 42. The base 42 may for example be tar paper, and the building material 40 may be roofing shingles. Alternatively, the base 42 may be wood underflooring material, and the building material 40 may be vinyl flooring.

The wings 22H also have the advantage of acting as stiffening flanges which help the plate 22 to retain its planar shape.

Plates of tool heads of the prior art have transverse bends therein, which tend to flatten after time, due to the pressures imposed on the plates under normal use. The plate 22 of the present invention is planar except for the teeth 22C, thus avoiding this problem.

Because the leading ends 24A of the ears 24 form a fulcrum 24E, the head 16 can be pivoted about the fulcrum 24E for lifting the building material 40 away from the base 42 when desired.

Because the ears 24B extend beyond the sleeve 18 and the handle 12 and form curved fulcrums 24E, the sleeve 18 and the handle 12 will not touch the base 42 when the tool 10 is in use. Handles and sleeves of the prior art which might touch the base when the tool is in use, can inadvertently and undesirably gouge and rip the base.

Because the leading ends 24A of the ears 24 are disposed primarily on the second side 22F of the plate 22, the building material 24 will ride smoothly up the plate 22 along the first side 22E of the plate 22, without catching on the leading ends 24A of the ears 24.

Referring to FIGS. 1 and 3A, the top edges of the ears 24 on the first side 22E of the plate 22 form a straight ramp 24F which intersects the plane of the plate 22. The building material 24 will ride smoothly up the ramp 24F after riding along the plate 22, as the head 16 is pushed forward.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. For example, and not by way of limitation, the head could be fixedly and immovably attached to the handle in any conventional way, instead of incorporating the ears and multiple holes which allow for adjustability of the head. Accordingly, the scope of the invention is to be limited only by the following claims and their legal equivalents.

What is claimed is:

1. A material removal tool comprising:

a. an elongated handle;

b. a head configured to attach to one end of said handle;

c. said head comprising a plate having a leading edge and a trailing edge;

d. a ripping means at said leading edge of the plate for ripping building material;

e. said plate being substantially flat except for said leading edge;

f. said plate having two side edges spanning between said leading and trailing edges;

g. a pair of wedge shaped wings, each of said side edges having one of said wings disposed there-along, each of said wings extending outwardly from said plate and forming a generally perpendicular angle with said plate;

and wherein said head further comprises:

h. a pair of ears configured to receive said one end of said handle therebetween;

i. said ears crossing a plane of said plate, and a leading end of each said ear being disposed on the same broad side of said plate as are said wings;

j. a notch extending inwardly from said leading end of each said ear;

k. a pair of bosses extending outwardly from opposing sides of said handle near said one end thereof, each of said bosses being configured to be received into one of said notches;

l. at least one hole in each of said ears near a trailing end thereof; and m. a pin configured to extend through said holes in said ears and through said handle inboard of said bosses, said head being fixedly retained on said handle when said pin extends through said holes in said ears and through said handle, and when said bosses are received within said notches.

2. The tool of claim 1, wherein each of the wings tapers from a first end near the trailing edge of the plate to a second end near the leading edge of the plate, the first end being wider than the second end.

3. The tool of claim 1, wherein the ripping means is a plurality of teeth disposed along the leading edge of the plate.

4. The tool of claim 1, wherein the entire leading ends of the ears on the same broad side of the plate as the wings extend completely beyond the end of the handle when the head is fixedly maintained on the handle.

5. The tool of claim 4, wherein the leading ends of the ears on the same broad side of the plate as the wings each form a curved fulcrum about which the handle is pivotable.

6. The tool of claim 1, wherein surfaces of the ears form a straight ramp on a side of the plate which is opposite the wings, the ramp intersecting the plate and forming an acute angle with respect to the plate, the head being devoid of structure protruding upwardly from the side of the plate which is opposite the wings, between the leading edge of the plate and an intersection of the ramp with the plate.

* * * * *